US012590519B2

(12) United States Patent
Kayode

(10) Patent No.: US 12,590,519 B2
(45) Date of Patent: Mar. 31, 2026

(54) METHOD AND SYSTEM FOR UPDATING A RESERVOIR SIMULATION MODEL BASED ON A WELL PRODUCTIVITY INDEX

(71) Applicant: SAUDI ARABIAN OIL COMPANY, Dhahran (SA)

(72) Inventor: Babatope Kayode, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 888 days.

(21) Appl. No.: 17/822,456

(22) Filed: Aug. 26, 2022

(65) Prior Publication Data

US 2024/0068340 A1 Feb. 29, 2024

(51) Int. Cl.

| | |
|---|---|
| ***E21B 43/16*** | (2006.01) |
| ***E21B 21/08*** | (2006.01) |
| ***E21B 47/06*** | (2012.01) |

(52) U.S. Cl.

CPC ..... *E21B 43/16* (2013.01); *E21B 21/08* (2013.01); *E21B 47/06* (2013.01); *E21B 2200/20* (2020.05)

(58) Field of Classification Search

CPC ..... E21B 43/16; E21B 21/08; E21B 47/06; E21B 2200/20

USPC ..... 703/10

See application file for complete search history.

(56) References Cited

U.S. PATENT DOCUMENTS

| | | | | |
|---|---|---|---|---|
| 5,871,047 | A | 2/1999 | Spath et al. | |
| 8,244,509 | B2 * | 8/2012 | Banerjee | E21B 43/00 702/11 |
| 8,401,832 | B2 | 3/2013 | Ghorayeb et al. | |
| 8,818,777 | B2 | 8/2014 | Howell et al. | |
| 10,184,320 | B2 * | 1/2019 | Al-Turki | G06F 30/20 |
| 11,840,927 | B2 * | 12/2023 | Dogru | G01V 20/00 |
| 2005/0194131 | A1 * | 9/2005 | Tseytlin | E21B 47/12 166/250.15 |
| 2008/0234939 | A1 * | 9/2008 | Foot | E21B 47/06 702/12 |

(Continued)

FOREIGN PATENT DOCUMENTS

| | | | |
|---|---|---|---|
| WO | 2005120195 | A2 | 12/2005 |
| WO | 2016115771 | A1 | 7/2016 |

OTHER PUBLICATIONS

Abdullah A. Almuraikhi (Productivity Index of Horizontal Gas Well, Graduate Theses, Dissertations, and Problem Reports, WVU, 2017, pp. 1-46) (Year: 2017).*

(Continued)

*Primary Examiner* — Iftekhar A Khan

(74) *Attorney, Agent, or Firm* — Osha Bergman Watanabe & Burton LLP

(57) ABSTRACT

A method comprises measuring a pressure at a plurality of times and a measured flow rate in a well. A measured productivity index (PI) is determined based, at least in part, on the measured flow rate and the pressure at the plurality of times. A flow rate at a second time is simulated, and a fluid pressure at the second time and a third time is simulated. A simulated PI is simulated based, at least in part, on the flow rate at the second time, and the fluid pressure at the second time and at the third time. An updated reservoir simulation model is generated by updating at least one parameter of the reservoir simulation model based, at least in part, on a difference between the measured PI and the simulated PI.

11 Claims, 7 Drawing Sheets

(56) References Cited

U.S. PATENT DOCUMENTS

| | | | | |
|---|---|---|---|---|
| 2012/0228027 | A1* | 9/2012 | Sehsah | E21B 21/08 175/48 |
| 2012/0303342 | A1 | 11/2012 | Hazlett et al. | |
| 2015/0149140 | A1* | 5/2015 | Gorell | E21B 43/00 703/10 |
| 2015/0361323 | A1* | 12/2015 | Gamage | C09K 8/52 166/305.1 |
| 2016/0187534 | A1* | 6/2016 | Dogru | E21B 43/00 703/2 |
| 2016/0312552 | A1* | 10/2016 | Early | E21B 41/00 |
| 2017/0177761 | A1* | 6/2017 | Early | E21B 41/00 |
| 2017/0204706 | A1* | 7/2017 | Guy | E21B 43/00 |
| 2017/0275970 | A1* | 9/2017 | Crawford | G01V 20/00 |
| 2019/0361146 | A1* | 11/2019 | Roth | G01V 1/50 |
| 2020/0318468 | A1* | 10/2020 | Alqahtani | E21B 43/30 |
| 2021/0301659 | A1* | 9/2021 | Al Shahri | E21B 49/087 |
| 2022/0259972 | A1* | 8/2022 | Shaker | G08B 21/182 |
| 2023/0102461 | A1* | 3/2023 | Oluwa | G06Q 10/0635 705/7.28 |
| 2023/0333278 | A1* | 10/2023 | Camargo | G01V 20/00 |
| 2023/0392489 | A1* | 12/2023 | Al-Hajri | E21B 43/25 |
| 2024/0068340 | A1* | 2/2024 | Kayode | E21B 43/00 |

OTHER PUBLICATIONS

Office Action issued by the Saudi Arabian Patent Office for corresponding Saudi Arabian patent application No. 123450245, mailed Mar. 23, 2025 (10 pages).

Adesina, Fadairo, et al., "A Realistic Model for Estimating Productivity Index of Vertical Well Using Wellhead Data", SPE-193506-MS, Society of Petroleum Engineers, Aug. 2018, pp. 1-10 (10 pages).

Dake, L.P., "Darcy's Law and Applications", Developments in Petroleum Science 8: fundamentals of reservoir engineering, Shell Learning Development, Elsevier Science B.V., vol. 8, 1978, pp. 100-126 (27 pages).

Sinha, Saurabh, et al., "Effect of Frequent Well Shut-In's on Well Productivity: Marcellus Shale Case Study", SPE-187506-MS, Society of Petroleum Engineers, Oct. 2017, pp. 1-10 (10 pages).

"Well inflow performance", ECLIPSE Technical Description, Version 2014.1, Schlumberger, 2014, pp. 1034-1050 (17 pages).

* cited by examiner

METHOD AND SYSTEM FOR UPDATING A RESERVOIR SIMULATION MODEL BASED ON A WELL PRODUCTIVITY INDEX

BACKGROUND

Reservoir simulation models play an important role in managing hydrocarbon resources in productive geological regions. In particular, a reservoir simulation model may be used to predict future oil, water, and gas production rates from a well in an oil and gas reservoir. For example, the location of a new well site at the hydrocarbon reservoir and the design of production equipment for the well may be guided by reservoir simulations. Accordingly, reservoir simulation models are often modified to simulate measured production rates in historical wells to sufficient accuracy. However, inconsistencies in the way simulated and measured production parameters are defined may lead to unnecessary modifications to the reservoir simulation model.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a method, comprising measuring, using a downhole pressure sensor, a pressure at a plurality of times in a well penetrating a hydrocarbon reservoir; measuring, using a flow meter, a measured flow rate in the well; determining a measured productivity index (PI) for the well based, at least in part, on the measured flow rate and the pressure at the plurality of times; obtaining a reservoir simulation model for the hydrocarbon reservoir; obtaining a fluid pressure distribution at a first time, wherein the fluid pressure distribution represents fluid pressure throughout at least a portion of the hydrocarbon reservoir; simulating a flow rate at a second time, and a fluid pressure at the second time and a third time using a reservoir simulator based on the reservoir simulation model and the fluid pressure distribution at the first time; simulating a simulated PI for the well based, at least in part, on the flow rate at the second time, and the fluid pressure at the second time and at the third time, wherein the second time is later than the first time and the third time is later than the second time; and generating an updated reservoir simulation model by updating at least one parameter of the reservoir simulation model based, at least in part, on a difference between the measured PI and the simulated PI.

In general, in one aspect, embodiments disclosed herein relate to a non-transitory computer-readable memory comprising computer-executable instructions stored thereon that, when executed on a processor, cause the processor to perform, receiving a pressure measured at a plurality of times in a well penetrating a hydrocarbon reservoir; receiving a measured flow rate in the well; determining a measured productivity index (PI) the well based, at least in part, on the measured flow rate and the pressure at the plurality of times; obtaining a reservoir simulation model for the hydrocarbon reservoir; obtaining a fluid pressure distribution at a first time, wherein the fluid pressure distribution represents fluid pressure throughout at least a portion of the hydrocarbon reservoir; simulating a flow rate at a second time, and a fluid pressure at the second time and a third time using a reservoir simulator based on the reservoir simulation model and the fluid pressure distribution at the first time; simulating a simulated PI for the well based, at least in part, on the flow rate at the second time, and the fluid pressure at the second time and at the third time, wherein the second time is later than the first time and the third time is later than the second time; and generating an updated reservoir simulation model by updating at least one parameter of the reservoir simulation model based on a difference between the measured PI and the simulated PI.

In general, in one aspect, embodiments disclosed herein relate to a system, comprising a well penetrating a hydrocarbon reservoir equipped with a flow meter and a downhole pressure sensor; and a reservoir simulator, configured to determine a measured productivity index (PI) for the well based, at least in part on a measured flow measured with the flow meter and a downhole pressure measured with downhole pressure sensor, obtain a reservoir simulation model and a fluid pressure distribution at a first time; simulate, using the reservoir simulation model, a flow rate at a second time, and a fluid pressure at the second time and a third time, simulate a simulated PI for the well based, at least in part on flow rate at the second time and on the fluid pressure at the second time and at the third time, wherein the second time is later than the first time and the third time is later than the second time, update at least one parameter of the reservoir simulation model based on a difference between the measured PI and the simulated PI.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
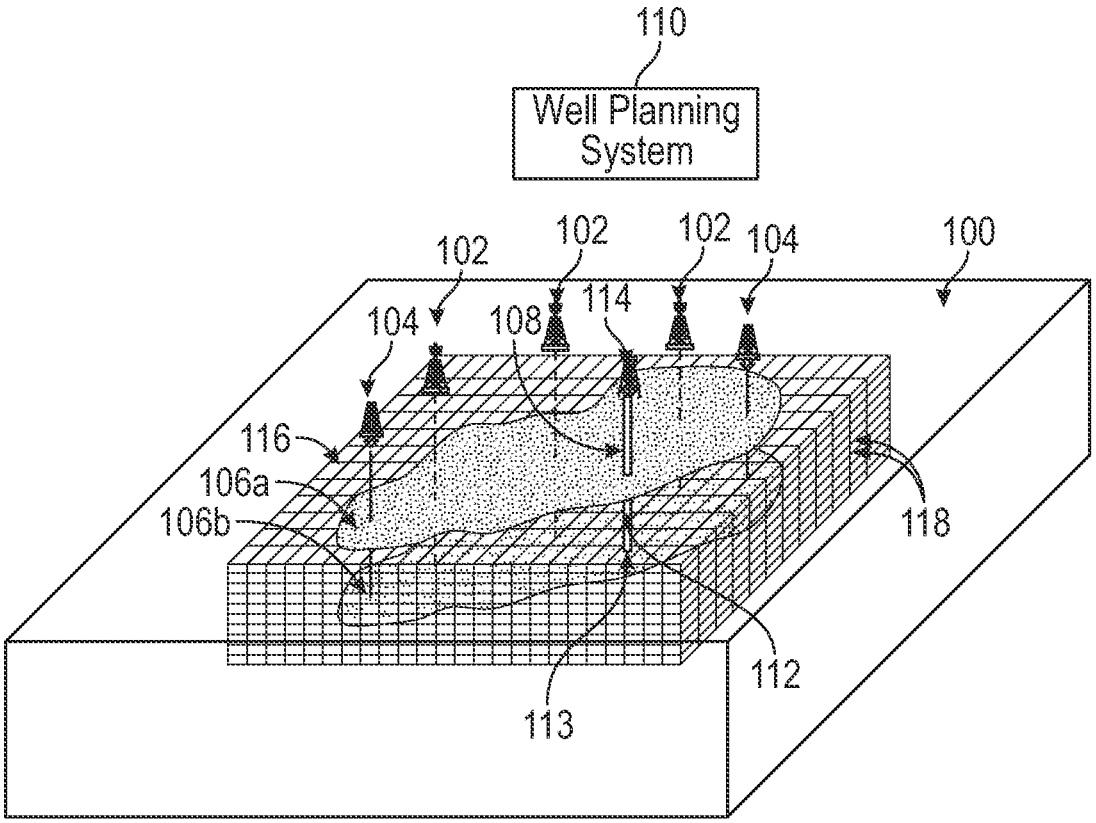
FIG. 1 illustrates a hydrocarbon reservoir in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a flow rate" includes reference to one or more of such flow rates.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-10, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure. Reservoir simulation plays an important role in planning and managing a hydrocarbon reservoir. Simulation typically involves representing the properties (e.g., rock porosity and permeability, and pore fluid pressure) of the reservoir on a grid of points. In an initial stage, termed "history matching", past ("historic") production, i.e., flow rates and downhole pressures, may be simulated and reservoir properties adjusted, iteratively, until simulated values match the historic measured values of flow rates and downhole pressures. In a second predictive phase, the behavior of the reservoir, including pore fluid pressure and phase changes of the fluid within the reservoir and production rates, may be simulated for various downhole pressure scenarios. Simulations may include cases where additional wellbore are drilled and/or fluid injection schedules are implemented. These predictions help inform the future operation of the reservoir.

The grid of points representing the reservoir may be relatively coarse over much of the reservoir because the spatial variation of pore fluid pressure is gentle. The coarseness makes the computation cost of the simulation tractable. However, near production wellbores pore fluid pressures may vary rapidly spatially making pressure gradients steep. Accurately simulating these steep gradients require densely sampled grids at least in the region surrounding the wells. In reservoirs containing hundreds or thousands of wells this may make the computation costs of simulations intractable. As an alternative, the relationship between flow rates, downhole pressure and pore fluid pressure far from the wellbore may be treated using a phenomenological factor termed the Productivity Index ("PI"). The PI may be inferred, indirectly, from measured data. The disclosed invention describes a method and application of determining the PI from first principles in a manner consistent with the value of PI inferred from measured date.

FIG. 1 depicts a hydrocarbon reservoir in accordance with one or more embodiments. As illustrated in FIG. 1, a subterranean region (100) may include one or more hydrocarbon reservoirs with various production wells (102). Likewise, a hydrocarbon reservoir region may also include one or more injection wells (104) that include functionality for enhancing production by one or more neighboring production wells. For example, injection wells (104) may inject fluid to maintain reservoir pressure and to sweep hydrocarbon, such as oil and gas, through the hydrocarbon reservoir towards the production wells. As shown in FIG. 1, wells may extend from the surface of the Earth through various overburden layers to penetrate the hydrocarbon reservoir that may be bounded by an upper reservoir surface (106*a*) and a lower reservoir surface (106*b*). Furthermore, a well planning system (110) may contemplate planned wells (108) (e.g., planned wellbore path (112)) at an identified hydrocarbon location (113) for a geological region. Wellbores may be drilled along a trajectory guided by the planned wellbore path (112) using a drilling system (114)).

Figure 2:
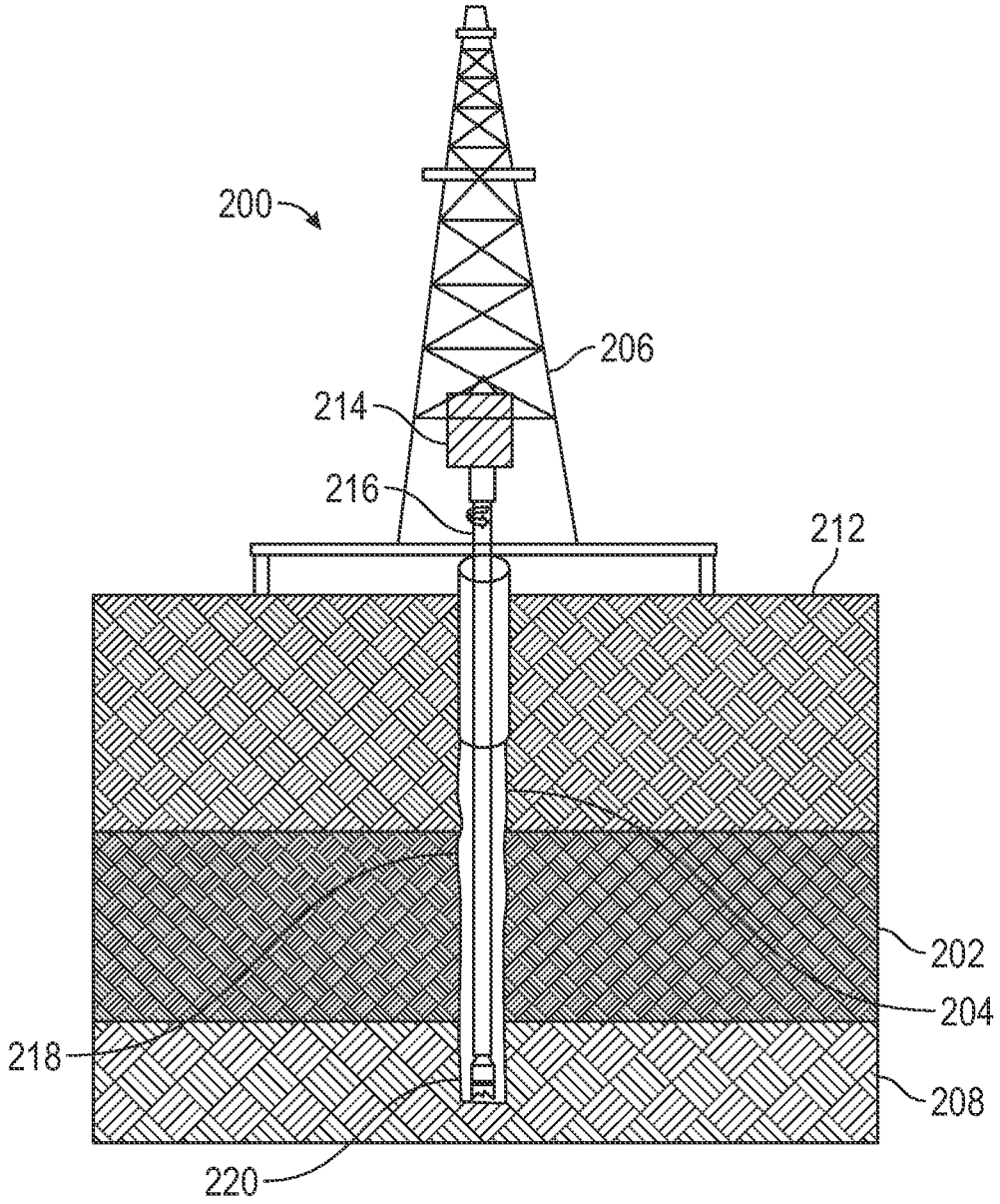
FIG. 2 shows a schematic diagram of a drilling system configured to drill a wellbore.

FIG. 2 depicts a schematic diagram of a drilling system (200) that may be used to drill a wellbore, such as wellbore (204) at an identified hydrocarbon location (113). As illustrated in FIG. 2, the wellbore may traverse a plurality of rock formations (202) that reside beneath the surface (212) of the Earth. The wellbore (204) extends from the surface (212) towards a target zone of the rock formations (202), such as a hydrocarbon reservoir (208). The wellbore (204) may be drilled for exploration, discovery, appraisal and/or extraction of hydrocarbons.

Major components of the drilling system (200) may include a drill rig (206), a top drive (214), a drive shaft (216), a drillstring (218), and a drill bit (220). The top drive (214) provides rotation to the drive shaft (216) that is connected to the drillstring (218). The drill bit (220) may include cutting elements and may be disposed at the bottom of the drill string (218). The rock of formations (202) may be broken apart mechanically by the cutting elements of the drill bit (220) by scraping, grinding or localized compressive fracturing. Drilling fluid, also referred to as "drilling mud" or simply "mud," may be pumped down the center of the drillstring (218) by a mud pump (not shown) to flush fragments of rock to the surface. The drilling fluid may also be used to facilitate drilling activities, such as cooling and lubricating the drill bit (220), and preventing pore fluids, such as oil or gas, from flowing prematurely into the wellbore.

Returning to FIG. 1, a reservoir simulation model (116) that corresponds to a portion of the subterranean region (100) may enclose at least a portion of the hydrocarbon reservoir. More specifically, the reservoir simulation model (116) may be represented by a plurality of grid blocks (118) that may be used to discretize reservoir properties, e.g., permeability, porosity or saturations. In some embodiments, the grid blocks may be cuboids, but in other embodiments the grid blocks may be irregularly shaped.

In some embodiments, a reservoir modeler may generate one or more reservoir simulation models (116). For example, the reservoir modeler may store well logs, fluid pressure distribution, and data regarding core samples for performing simulations. A reservoir modeler may further analyze the well log data, the fluid pressure distribution, the core sample data, and other types of data to generate and/or update the one or more reservoir simulations models (116). In some embodiments, the reservoir modeler may include a computer system that is similar to the computer system (1000) described below with regard to FIG. 10 and the accompanying description.

In some embodiments, a reservoir simulator may simulate the fluid flow rate of a production well (102) using a reservoir simulation model (116). When a production well (102) is active, the production well (102) is acquiring hydrocarbon production from a hydrocarbon reservoir, and the fluid flow rate can be measured. In particular, where production data may exist for an active production well, such production data may be compared with production simulated with a reservoir simulation model. The reservoir simulation model (116) may then be updated iteratively until achieving a satisfactory match between simulated production and measured production. The reservoir simulation model (116) updated in this manner is considered to be an accurate representation of the actual hydrocarbon reservoir. Using the updated reservoir simulation model (116) the reservoir simulator may simulate future production for various scenarios, for example, injection schedules, future proposed wells, and artificial lift programs, among others.

Production from a production a well (102) depends on the temporal and spatial the fluid pressure distribution throughout the hydrocarbon reservoir. In the neighborhood of production wells (102) the fluid pressure distribution may exhibit rapid spatial variations, and simulating accurately this rapid variation may require the use of fine grid blocks in the reservoir simulation model (116). Spatial discretization of the reservoir simulation model (116) with fine grid blocks may easily become prohibitively expensive, and thus performing simulations of detailed fluid behavior around the well may be difficult. Prediction and measurement of well production is therefore treated in a phenomenological manner by means of a Productivity Index (PI) that relates the pressure and the measured flow rate for individual wells to the fluid pressure beyond the neighborhood of the well. Accurate estimations of the PI are thus important, since the PI may be used in the iterative update of the reservoir simulation model (116), for example, in the iterative modification of one or more reservoir properties such as permeability, porosity, saturation, etc. Mis-characterizing the PI may lead the analyst to perform misguided modifications to the reservoir simulation model (116) and thus, introduce errors, in the reservoir simulation model (116).

Figure 3:
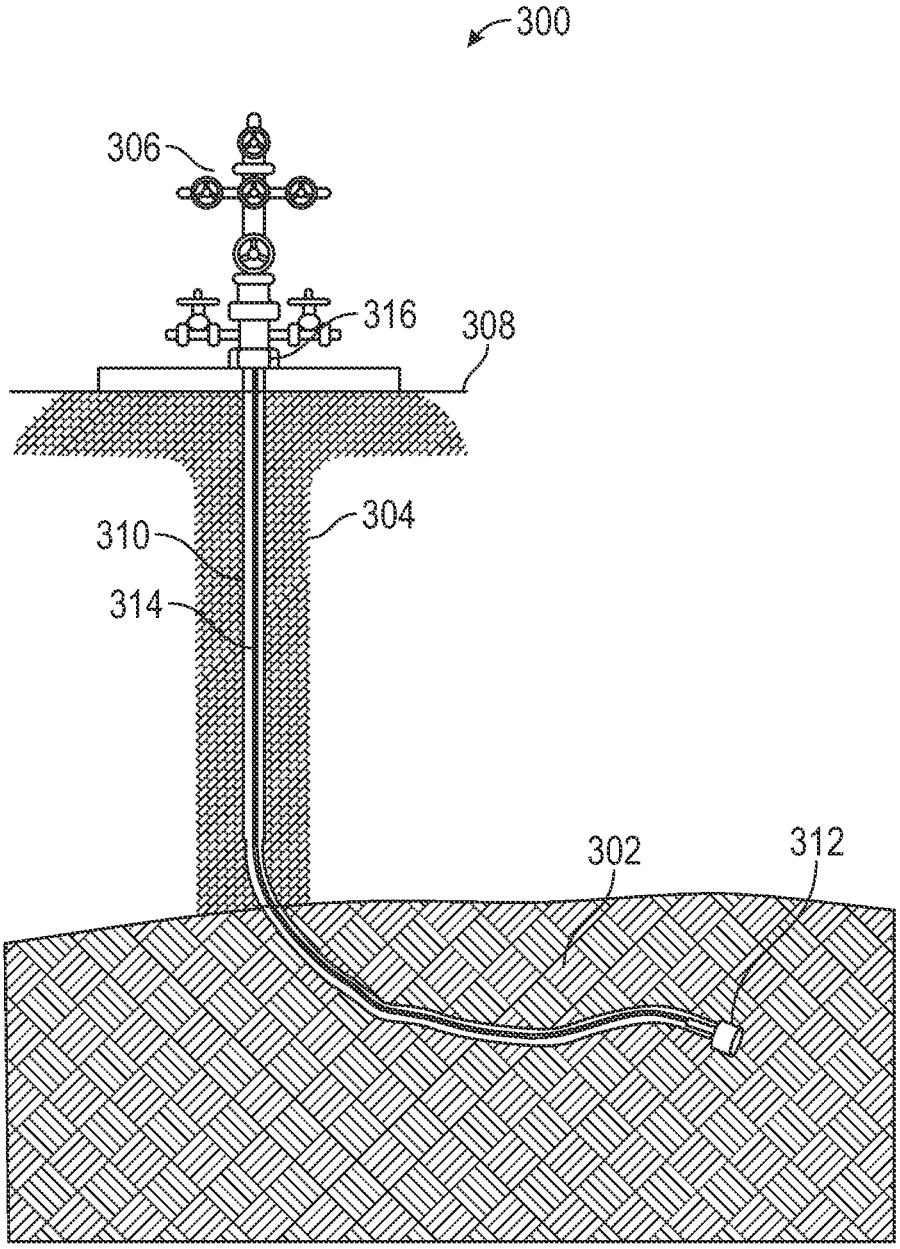
FIG. 3 illustrates a production well in accordance with one or more embodiments.

FIG. 3 depicts a production well in accordance with one or more embodiments. FIG. 3 illustrates a production well (300) that includes a hydrocarbon reservoir (302) located beneath an overburden (304) and a production well head (306). The overburden (304) may include a plurality of rock formations lying beneath the surface of the Earth ("surface") (308) but above the hydrocarbon reservoir (302). Typically, the overburden (304) may include a plurality of layers of porous and non-porous rocks that do not contain hydrocarbons in commercially exploitable quantities and/or are not currently of interest. The overburden (304) may include at least one non-porous layer immediately above the hydrocarbon reservoir (302) that serves as a seal to the hydrocarbon reservoir (302) and prevents the escape of the hydrocarbons upward. The overburden (304) and the hydrocarbon reservoir (302) may include different layers of rock having varying characteristics, such as varying degrees of permeability, porosity, and resistivity.

In some embodiments the production well (300) may include a wellbore (310) that extends from the surface (308) into the hydrocarbon reservoir (302), and a production well head (306). A lower end of the wellbore, terminating in the hydrocarbon reservoir (302), may be referred to as the "downhole" end of the wellbore (310). The wellbore (310) may facilitate the flow of hydrocarbon production (e.g., oil and gas) from the hydrocarbon reservoir (302) to the surface (308) during production operations, and the communication of monitoring devices (e.g., a communication channel (314), a downhole pressure sensor (312)) in the hydrocarbon reservoir (302) during monitoring operations.

In some embodiments, the production well head (306) may include a rigid structure where the wellbore (310) intersects the surface (308). Production may flow from the wellbore, through the production well head (306), and into surface pipelines or storage tanks (not shown). In some embodiments, the production well head (306) may include a fluid flow rate sensor, or flow meter (316) operable to measure the fluid flow rate after it exits the wellbore (310). In some embodiments, the production well head (306) includes flow operation devices that are operable to control the flow of fluids into and out of the wellbore (310). For example, the production well head (306) may include one or more production valves (not shown) that control the flow of production. For example, a production valve may be fully opened to enable unrestricted flow of production from the wellbore (310), the production valve may be partially opened to partially restrict the flow of production from the wellbore (310), and the production valve may be fully closed to prevent flow of production from the wellbore (310).

Figure 4:
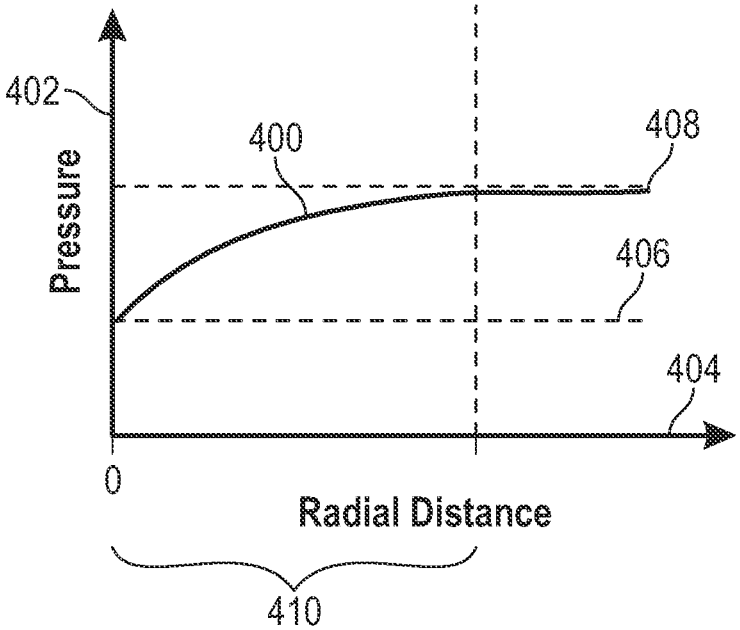
FIG. 4 illustrates the distribution of pressures at a well for a homogeneous hydrocarbon reservoir under steady state flow conditions.

FIG. 4 depicts the fluid pressure distribution (400) within a homogeneous hydrocarbon reservoir in the neighborhood of a well producing at a steady rate. The fluid pressure is indicated on the vertical axis (402) and radial distance from the well is indicated on the horizontal axis (404). The lowest pressure is expected to occur at the well, and may be termed the downhole pressure $p_{wf}$ (406), where "wf" indicates "well flowing". At increasing radial distance from the well the fluid pressure asymptotes to the far-field pressure $p_e$ (408), beyond a zone of influence (410) of the well.

While the downhole pressure $p_{wf}$ (406) may be measured directly during production, the far-field pressure $p_e$ (408) and the extent of the zone of influence (410) of the well may only be inferred indirectly. For example, during a shut-in period production from the well is suspended and the flow rate q becomes zero. Under these shut-in conditions the fluid pressure at the well equilibrates and the downhole pressure $p_{wf}$ (406) increases from its lowest value, the value recorded when the well is flowing, until it reaches equilibrium with the far-field pressure $p_e$ (408). Furthermore, while the downhole pressure $p_{wf}$ (406) increases relatively rapidly during a shut-in interval the far-field pressure $p_e$ (408) is considered to be essentially constant during the shut-in interval.

Figure 5:
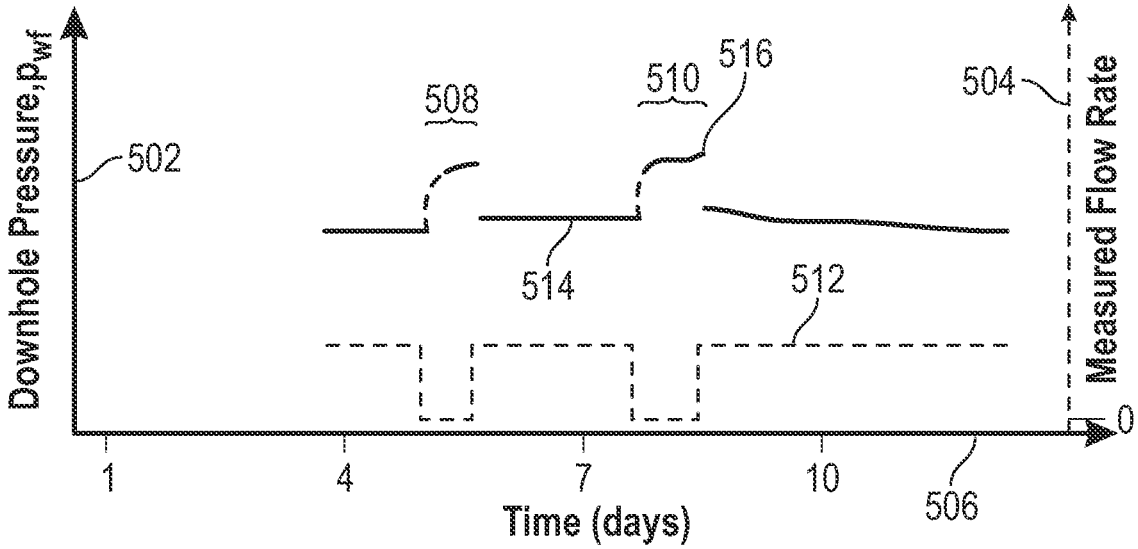
FIG. 5 illustrates an example of the time variation of a well's downhole pressure and of the production rate during a series of shut-in periods.

FIG. 5 shows an example of the time variation of well's downhole pressure and of the production rate during a series of shut-in periods. The downhole pressure is indicated in the vertical axis of the left-hand side (502), and the measured flow rate is indicated in the vertical axis on the right-hand side (504). The time of production in days is indicated in the horizontal axis (506). Two shut-in periods (508) and (510) are illustrated in FIG. 5. As shown in FIG. 5, when the fluid flow rate (512) is constant, the well's downhole pressure $p_{wf}$ (514) has low variations and is continuous. During the shut-in periods (508) and (510), the fluid flow rate (512) is zero, and the downhole pressure $p_{wf}$ (514) asymptotes to a stabilized value (516) after a sufficient shut-in time has elapsed. The stabilized value (516) of downhole pressure of the shut-in period may be considered a good estimate of the fluid pressure beyond the limit of the zone of influence (410) of the well $p_e$. Therefore, the far-field pressure $p_e$ (408) may be inferred from the stabilized value (516) of the downhole pressure. The stabilized value of downhole pressure may occur after a sufficient time interval after the commencement of the shut-in has elapsed.

The downhole pressure $p_{wf}$ (406) measured when the well is producing at a measured flow rate q, and the inferred far-field pressure $p_e$ (408), may be used to determine a measured productivity index (PI) for the well as the quotient:

$$PI = \frac{q}{p_e - p_{wf}}. \tag{1}$$

Estimates of the measured PI in the field may be obtained using Eq. (1), with q and $p_{wf}$ (406) measured at a time just before the beginning of a shut-in period, and with $p_e$ (408) inferred from the stabilized value (516) of the downhole pressure measured during the shut-in period.

In accordance with some embodiments, a reservoir simulation may provide estimates of the flow rate q, the far-field pressure $p_e$ (408) and the downhole pressure $p_{wf}$ (406) for a production well. Furthermore, the reservoir simulator may simulate the simulated PI at each time step t while the well is flowing, using the following expression:

$$PI = \frac{q}{WBP - p_{wf}}, \tag{2}$$

$$q = q(t), \quad p_{wf} = p_{wf}(t), \quad WBP = WBP(t),$$

where WBP is the pressure from a representative grid block, also known as the well block pressure. Other far-field pressure estimates may be used instead of WBP in Equation (2) without departing from the scope of the invention. For example, a weighted average pressure within a 1-grid block, 4-grid block, 5-grid block and 9-grid block region around each connecting grid block may be used. However, during a shut-in period the flow rate is zero (as illustrated for the shut-in periods (508) and (510)), and thus some numerical modelers that use Equation (2) at each time step predict a zero simulated PI during the shut-in periods. Such result does not allow a useful comparison between the simulated PI and the measured PI. The simulated PI may be alternatively measured using the simulated parameters q, WBP, and $p_{wf}$ simulated at an instant just before the start of the shut-in period. This alternative way of estimating the simulated PI is also inconsistent with the measured PI, because the pressure WBP just before the start of the shut-in period is not representative of the far-field pressure $p_e$ (408), as discussed below.

Figure 6:
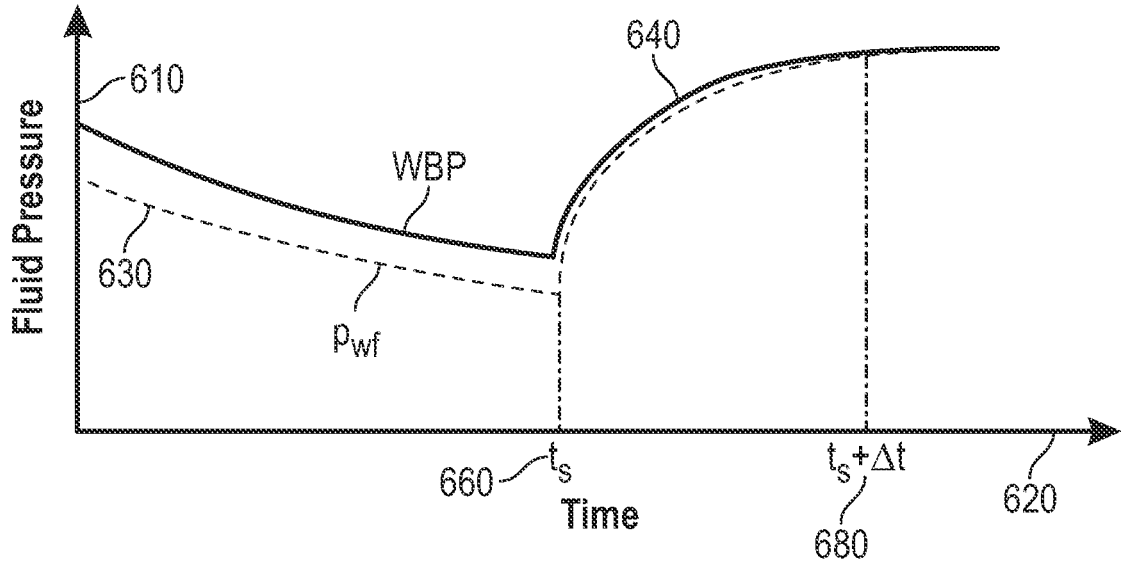
FIG. 6 illustrates an example of the time variation of the simulated well's downhole pressure, and the well block pressure.

FIG. 6 shows an example of the time variation of the simulated well's downhole pressure $p_{wf}$, and the well block pressure WBP. The simulated pressure is indicated in the vertical axis (610), and the time instants are indicated in the horizontal axis (620). FIG. 6 illustrates that both simulated pressures, $p_{wf}$ (630) and WBP (640), smoothly decrease until the initial time $t_s$ (660) of a shut-in period. During the shut-in period both simulated pressures $p_{wf}$ (630) and WBP (640) start to rapidly increase until reaching a stabilized value. A stable value can be considered to be reached for example at the time $t_s+\Delta t$ (680) when the rate of change of WBP tends to vanish, as illustrated in FIG. 6. Thus, a simulated pressure WBP (640) at the time $t_s+\Delta t$ (680) appears to be representative of far-field pressure $p_e$ (408), and thus, more suitable to compute the simulated PI.

Figure 7:
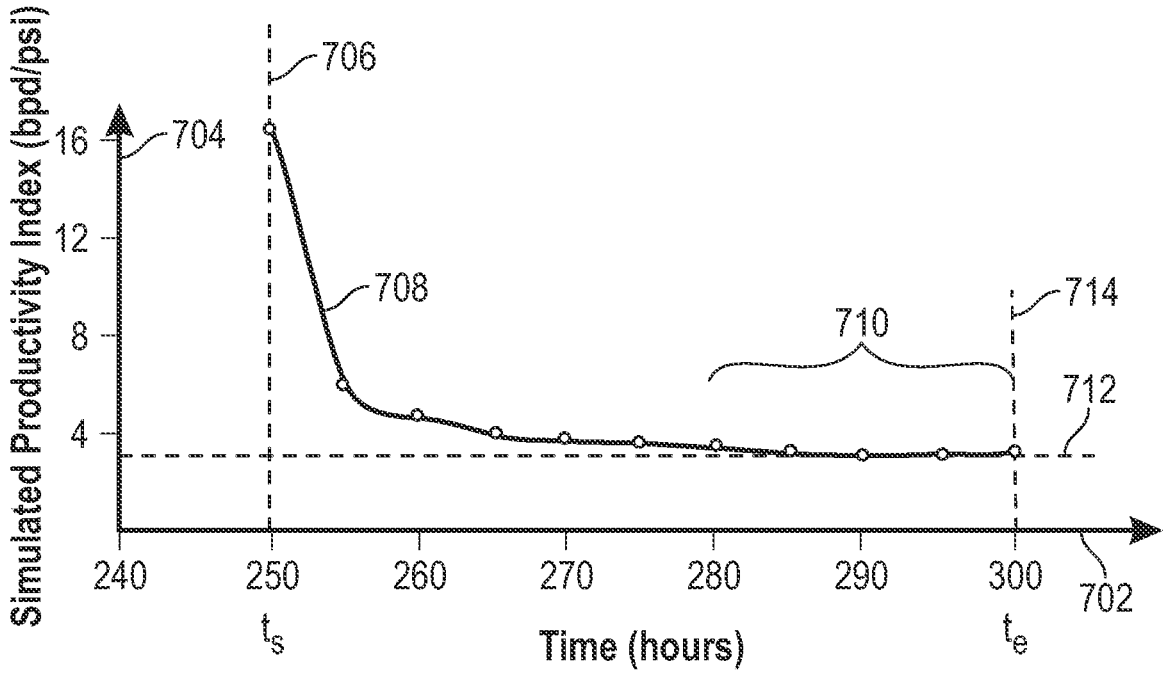
FIG. 7 illustrates an example of the time variation of simulated productivity index during a complete shut-in period.

FIG. 7 illustrates an example of the time variation of simulated PI during a complete shut-in period. The time measured in hours is indicated by the horizontal axis (702) in FIG. 7, $t_s$ (706) is the initial time of the shut-in period, and $t_e$ (714) is the end time of the shut-in period. The simulated PI of FIG. 7, indicated by the vertical axis (704), was estimated using Eq. (2) with the simulated parameters q and $p_{wf}$ taken at $t_s$, the initial time of the shut-in period (706), while WBP was taken at different time instants during the shut-in period. FIG. 7 shows an example in which the shut-in period has a first stage in which the initial value of the simulated PI, the value at $t_s$, has a rapid decrease (708). As the simulated pressure WBP increases with time to reach stable values, the simulated PI in FIG. 7 continues decreasing, but at a lower rate. In the last portion of the shut-in period (710) the simulated PI asymptotes to the lowest value (712) of the simulated PI during the shut-in period. It is this lowest value (712) of the simulated PI reached in the last portion of the shut-in period (710) that corresponds to the values of the measured PI obtained in the field, since it is based on a pressure WBP representative of the far-field pressure $p_e$ (408). If the value of the simulated PI at $t_s$ is chosen to be used in a history matching process, a non-realistic difference with the measured PI might lead to implement unnecessary modifications to the reservoir simulation model. Accordingly, in some embodiments of this disclosure the simulated PI is estimated using to the following equation:

$$PI = \frac{q}{WBP - p_{wf}}, \tag{3}$$

$$q = q(t_s),$$

$$p_{wf} = p_{wf}(t_s),$$

$$WBP = WBP(t_s + \Delta t),$$

where $t_s$ is the initial time of the shut-in period (706), and $t_s+\Delta t$ is a time during the shut-in period when the simulated pressure WBP has stabilized.

Figure 8:
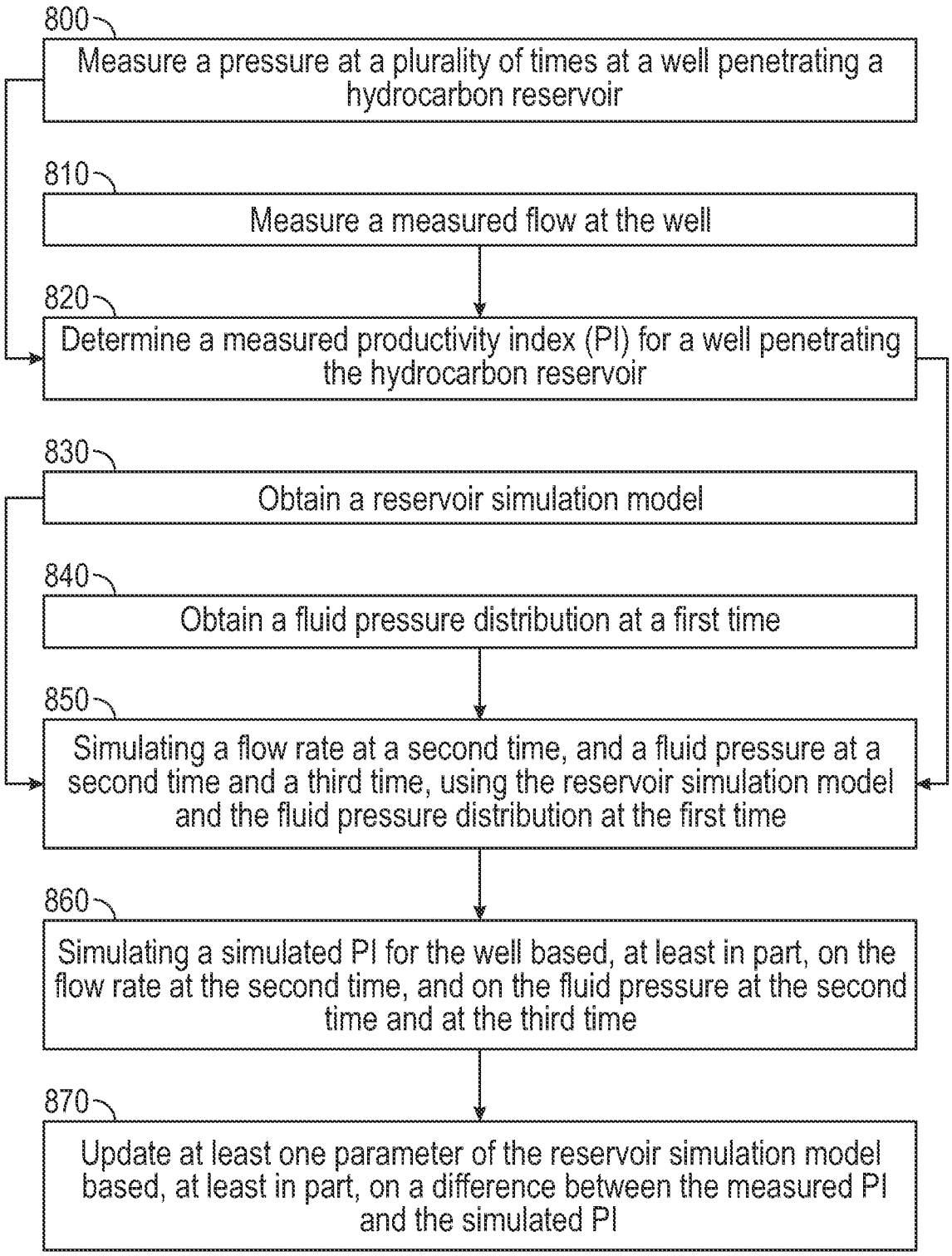
FIG. 8 shows a flowchart describing a method for updating a reservoir simulation model using a measured productivity index, in accordance with one or more embodiments.

FIG. 8 shows a flowchart in accordance with one or more embodiments. Specifically, FIG. 8 describes a workflow for updating a reservoir simulation model using a measured PI. While the various blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

The workflow initiates with block (800), measuring a pressure at a plurality of times at a production well penetrating a hydrocarbon reservoir, and with block (810), measuring the flow rate at the production well.

In block (820), a measured PI is obtained using the measured pressure data and the flow rate. The measured PI may be based upon a quotient of the flow rate prior to shut-in and the difference between a stabilized downhole pressure at a period of time after shut-in and the downhole pressure prior to shut-in.

In block (830) a reservoir simulation model may be obtained. The reservoir simulation model may include a spatial distribution of porosity and permeability. Each of these distributions may be discretized on an array of grid points or an array of grid blocks.

In block (840) an initial spatial distribution of pore fluid pressure may be obtained. The pore fluid distribution may be discretized on an array of grid points or an array of grid blocks. The pore fluid may be discretized using the same array of grid points as the porosity and permeability or using a distinct but overlapping array of grid points.

In block (850), using the input data obtained in previous steps, simulation data are obtained from a reservoir simulation at a second time and at a third time, in accordance with one or more embodiments. The second time may be, for example, the time $t_s$ at the beginning of a shut-in period. Production data may be simulated as a well flow rate at a second time $t_s$ and the pressure may be simulated as the well flowing bottom-hole pressure at the second time $t_s$. The third time, is a later time $t_s+\Delta t$, which, in some embodiments, may be the end of the shut-in period. Alternatively, the third time $t_s+\Delta t$ may correspond to an instant during a shut-in period in which the rate of change of the well block pressure is less than a predetermined stability threshold. In some embodiments the output pressure data obtained from the reservoir simulation at $t_s+\Delta t$ is the well block pressure WBP. A weighted average pressure over several blocks surrounding the well may be also obtained.

In block (860) a simulated PI at one or more wells during shut-in periods are estimated in accordance with one or more embodiments. In doing so, the reservoir simulator may use simulation data, for example, the well flow rate at $t_s$, the well flowing bottom-hole pressure at $t_s$, and the well block pressure WBP at the time $t_s+\Delta t$. Next, the obtained simulated PI is compared to the measured PI at one or more wells as shown in block, in accordance with one or more embodiments. One or more reservoir model parameters, such as porosity and permeability, may be modified to reduce the difference between simulated and measured PI, as shown in block (870). In some embodiments, the reservoir simulation model is iteratively or recursively modified until the simulated PI matches the measured PI to within a specified tolerance. The simulation model that generates a matching PI may be termed a validate reservoir simulation model.

In accordance with one or more embodiments, the validated reservoir simulation model may be used in a predictive manner to simulate the fluid flow and pressure within the hydrocarbon reservoir and production from one or more for future reservoir management scenarios. For example, these predictions may be used to identify the locations for new infill wells and forecast the potential production of the new wells. A wellbore path may then be planned to intersect the identified location of new infill wells, and, finally a drilling system may be installed to drill a well. In another application, a reservoir simulation in a predictive phase may provide the potential production of a well, which is an important input parameter to determine the capacity of Electric Submersible Pumps (ESP). Equipment such as an ESP is used to lift fluids in a well from the downhole to the surface in the case the reservoir pressure is not high enough to naturally lift the fluids from the downhole to the surface.

Figure 9:
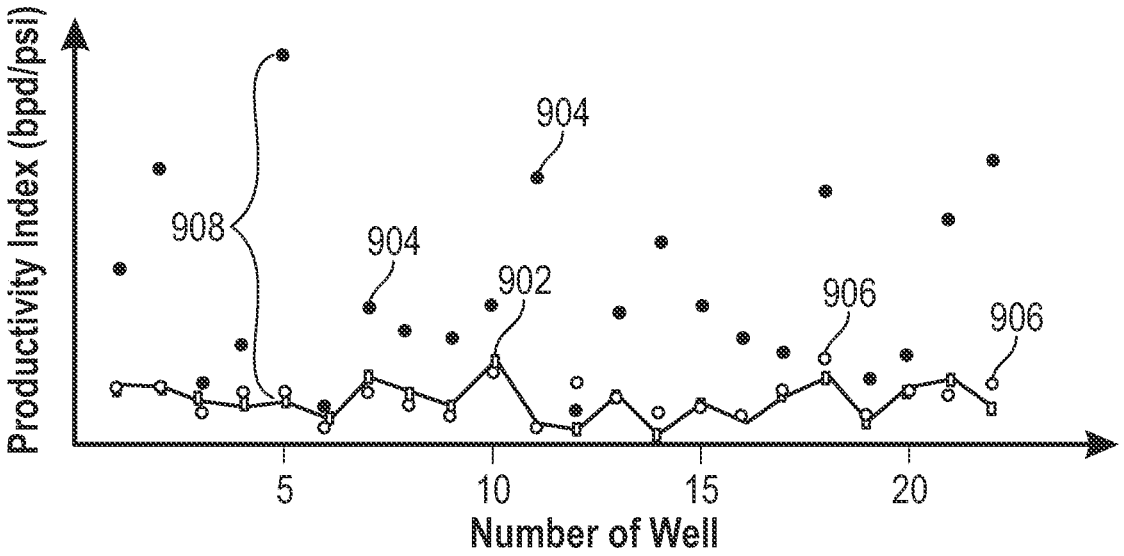
FIG. 9 illustrates an example of the measured productivity index at 22 different wells in a hydrocarbon reservoir, compared with the simulated productivity index in accordance with one or more embodiments.

FIG. 9 shows measured and simulated PI at 22 different wells in a hydrocarbon reservoir. The simulation has been performed using two different methods for each well. Filled squares represent measured PI values (902). Filled circles represent simulated PI values (904) obtained using well block pressure, WBP, taken at the beginning of the shut-in period. Open circles represent simulated PI (906) obtained following the workflow illustrated in FIG. 8, i.e., using stable well block pressure taken at the end of each shut-in period. FIG. 9 clearly shows the large differences (908) between the simulated PI values (904) and the measured PI values (902). In contrast, very small differences are observed between the measured PI values (902) and the values of the simulated PI (906) obtained with the workflow illustrated in FIG. 8.

Figure 10:
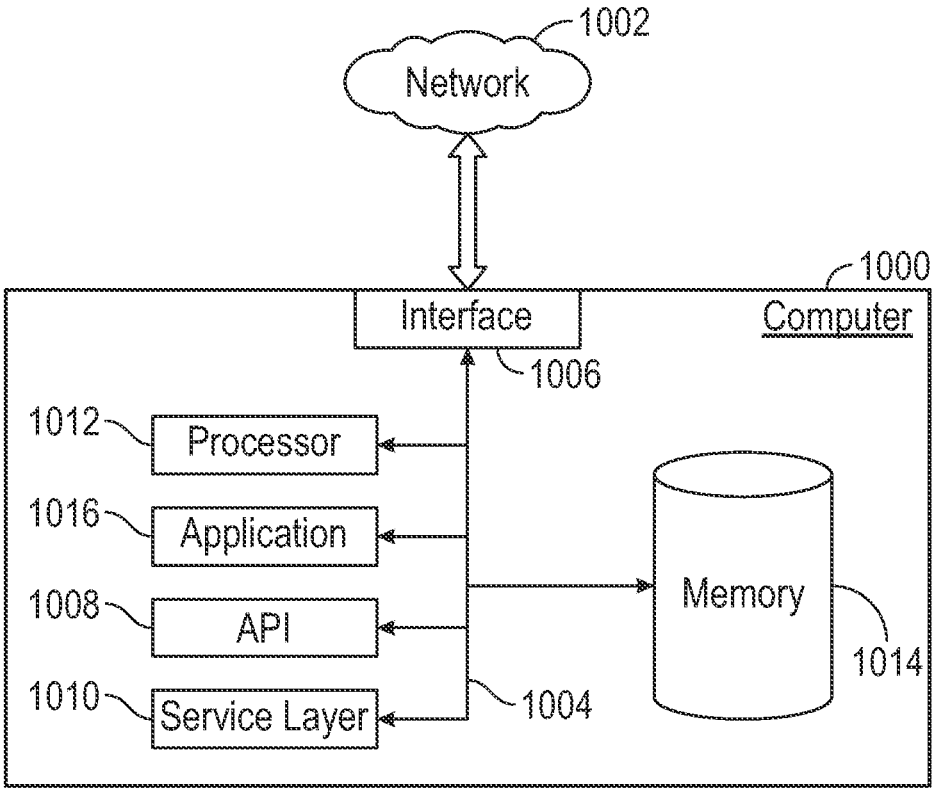
FIG. 10 shows a computing system in accordance with one or more embodiments.

Embodiments may be implemented on a computer system. FIG. 10 is a block diagram of a computer system (1000) used to provide computational functionalities associated with described algorithms, methods, functions, processes, flows, and procedures as described in the instant disclosure, according to an implementation. The illustrated computer system (1000) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer system (1000) may include a computer that includes an input device, such as a keypad, keyboard, touch screen, or other device that can accept user information, and an output device that conveys information associated with the operation of the computer system (1000), including digital data, visual, or audio information (or a combination of information), or a GUI.

The computer system (1000) can serve in a role as a client, network component, a server, a database or other persistency, or any other component (or a combination of roles) of a computer system for performing the subject matter described in the instant disclosure. The illustrated computer system (1000) is communicably coupled with a network (1002). In some implementations, one or more components of the computer system (1000) may be configured to operate within environments, including cloud-computing-based, local, global, or other environment (or a combination of environments).

At a high level, the computer system (1000) is an electronic computing device operable to receive, transmit, process, store, or manage data and information associated with the described subject matter. According to some implementations, the computer system (1000) may also include or be communicably coupled with an application server, e-mail server, web server, caching server, streaming data server, business intelligence (BI) server, or other server (or a combination of servers).

The computer system (1000) can receive requests over network (1002) from a client application (for example, executing on another computer system (1000)) and responding to the received requests by processing the said requests in an appropriate software application. In addition, requests may also be sent to the computer system (1000) from internal users (for example, from a command console or by other appropriate access method), external or third-parties, other automated applications, as well as any other appropriate entities, individuals, systems, or computers.

Each of the components of the computer system (1000) can communicate using a system bus (1004). In some implementations, any or all of the components of the computer system (1000), both hardware or software (or a combination of hardware and software), may interface with each other or the interface (1006) (or a combination of both) over the system bus (1004) using an application programming interface (API) (1008) or a service layer (1010) (or a combination of the API (1008) and service layer (1010). The API (1008) may include specifications for routines, data structures, and object classes. The API (1008) may be either computer-language independent or dependent and refer to a complete interface, a single function, or even a set of APIs. The service layer (1010) provides software services to the computer system (1000) or other components (whether or not illustrated) that are communicably coupled to the computer (1000). The functionality of the computer (1000) may be accessible for all service consumers using this service layer. Software services, such as those provided by the service layer (1010), provide reusable, defined business functionalities through a defined interface. For example, the interface may be software written in JAVA, C++, or other suitable language providing data in extensible markup language (XML) format or other suitable format. While illustrated as an integrated component of the computer (1000), alternative implementations may illustrate the API (1008) or the service layer (1010) as stand-alone components in relation to other components of the computer (1000) or other components (whether or not illustrated) that are communicably coupled to the computer (1000). Moreover, any or all parts of the API (1008) or the service layer (1010) may be implemented as child or sub-modules of another software module, enterprise application, or hardware module without departing from the scope of this disclosure.

The computer (1000) includes an interface (1006). Although illustrated as a single interface (1006) in FIG. 10, two or more interfaces (1006) may be used according to particular needs, desires, or particular implementations of the computer (1000). The interface (1006) is used by the computer (1000) for communicating with other systems in a distributed environment that are connected to the network (1002). Generally, the interface (1006) includes logic encoded in software or hardware (or a combination of software and hardware) and operable to communicate with the network (1002). More specifically, the interface (1006) may include software supporting one or more communication protocols associated with communications such that the network (1002) or interface's hardware is operable to communicate physical signals within and outside of the illustrated computer (1000).

The computer (1000) includes at least one computer processor (1012). Although illustrated as a single computer processor (1012) in FIG. 10, two or more processors may be used according to particular needs, desires, or particular implementations of the computer (1000). Generally, the computer processor (1012) executes instructions and manipulates data to perform the operations of the computer (1000) and any algorithms, methods, functions, processes, flows, and procedures as described in the instant disclosure.

The computer (1000) also includes a memory (1014) that holds data for the computer (1000) or other components (or a combination of both) that may be connected to the network (1002). For example, memory (1014) may be a database storing data consistent with this disclosure. Although illustrated as a single memory (1014) in FIG. 10, two or more memories may be used according to particular needs, desires, or particular implementations of the computer (1000) and the described functionality. While memory (1014) is illustrated as an integral component of the computer (1000), in alternative implementations, memory (1014) may be external to the computer (1000).

In addition to holding data, the memory may be a non-transitory medium storing computer readable instruction capable of execution by the computer processor (1012) and having the functionality for carrying out manipulation of the data including mathematical computations.

The application (1016) is an algorithmic software engine providing functionality according to particular needs, desires, or particular implementations of the computer (1000), particularly with respect to functionality described in this disclosure. For example, application (1016) can serve as one or more components, modules, applications, etc. Further, although illustrated as a single application (1016), the application (1016) may be implemented as multiple applications (1016) on the computer (1000). In addition, although illustrated as integral to the computer (1000), in alternative implementations, the application (1016) may be external to the computer (1000).

There may be any number of computers (1000) associated with, or external to, a computer system containing computer (1000), each computer (1000) communicating over network (1002). Further, the term "client," "user," and other appropriate terminology may be used interchangeably as appropriate without departing from the scope of this disclosure. Moreover, this disclosure contemplates that many users may use one computer (1000), or that one user may use multiple computers (1000).

In some embodiments, the computer (1000) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method, comprising:

measuring, using a downhole pressure sensor, a pressure at a plurality of times in a well penetrating a hydrocarbon reservoir;

measuring, using a flow meter, a measured flow rate in the well;

determining a measured productivity index (PI) for the well based, at least in part, on the measured flow rate and the pressure at the plurality of times;

generating, using a reservoir modeler, a reservoir simulation model comprising a discretized representation of a spatial distribution of a permeability of the hydrocarbon reservoir, the reservoir simulation model configured to simulate a fluid flow rate from the hydrocarbon reservoir;

obtaining, from the reservoir modeler, a fluid pressure distribution at a first time, wherein the fluid pressure distribution represents fluid pressure throughout at least a portion of the hydrocarbon reservoir;

simulating a flow rate at a second time, a first fluid pressure at the second time and a second fluid pressure at a third time using a reservoir simulator based on the reservoir simulation model and the fluid pressure distribution at the first time, wherein the second time is later than the first time and the third time is later than the second time;

simulating a simulated PI for the well based, at least in part, on a quotient of the flow rate at the second time and a difference between the first fluid pressure at the second time and the second fluid pressure at the third time;

generating an updated reservoir simulation model by updating at least one parameter of the reservoir simulation model based, at least in part, on a difference between the measured PI and the simulated PI;

simulating the fluid pressure distribution at a fourth time using the updated reservoir simulation model;

identifying a location for drilling an infill well based, at least in part, on the fluid pressure distribution at the fourth time;

planning a wellbore path to intersect the location, and drilling the infill well guided by the wellbore path using a drilling system.

2. The method of claim 1, wherein the parameter of the reservoir simulation model is a porosity or a permeability.

3. The method of claim 1, wherein a rate of change of the second fluid pressure is less than a predetermined value.

4. The method of claim 1, wherein the first fluid pressure is a downhole pressure of the well and the second fluid pressure is a far-field pressure.

5. The method of claim 4, wherein the downhole pressure of the well comprises a simulated pressure at an initial time of a shut-in period, and the far-field pressure is a well block pressure simulated at an end time of the shut-in period.

6. A non-transitory computer-readable memory comprising computer-executable instructions stored thereon that, when executed on a processor, cause the processor to perform:

receiving a pressure measured using a downhole pressure sensor at a plurality of times in a well penetrating a hydrocarbon reservoir;

receiving a measured flow rate in the well, the measured flow rate measured using a flow meter;

determining a measured productivity index (PI) the well based, at least in part, on the measured flow rate and the pressure at the plurality of times;

generating, using a reservoir modeler, a reservoir simulation model comprising a discretized representation of a spatial distribution of a permeability of the hydrocarbon reservoir, the reservoir simulation model configured to simulate a fluid flow rate from the hydrocarbon reservoir;

obtaining, from the reservoir modeler, a fluid pressure distribution at a first time, wherein the fluid pressure distribution represents fluid pressure throughout at least a portion of the hydrocarbon reservoir;

simulating a flow rate at a second time, a first fluid pressure at the second time and a second fluid pressure at a third time using a reservoir simulator based on the reservoir simulation model and the fluid pressure distribution at the first time, wherein the second time is later than the first time and the third time is later than the second time;

simulating a simulated PI for the well based, at least in part, on a quotient of the flow rate at the second time, and a difference between the first fluid pressure at the second time and the second fluid pressure at the third time;

generating an updated reservoir simulation model by updating at least one parameter of the reservoir simulation model based on a difference between the measured PI and the simulated PI;

simulating the fluid pressure distribution at a fourth time using the updated reservoir simulation model, and identifying a location for drilling an infill well based, at least in part, on the fluid pressure distribution at the fourth time.

7. The non-transitory computer-readable memory of claim 6, further comprising computer-executable instructions for simulating a second fluid pressure at a time corresponding to a rate of change of the second fluid pressure being less than a predetermined value.

8. The non-transitory computer-readable memory of claim 6, further comprising computer-executable instructions for simulating a first fluid at a downhole of the well and a second fluid pressure as a far-field pressure.

9. A system, comprising:

a well penetrating a hydrocarbon reservoir equipped with a flow meter and a downhole pressure sensor, wherein the flow meter is configured to measure a measured flow rate in the well and the downhole pressure sensor is configured to measure a downhole pressure at a plurality of times in the well;

a reservoir simulator, configured to:

determine a measured productivity index (PI) for the well based, at least in part, on the measured flow rate and the downhole pressure, generate, using a reservoir modeler, a reservoir simulation model comprising a discretized representation of a spatial distribution of a permeability of the hydrocarbon reservoir, the reservoir simulation model configured to simulate a fluid flow rate from the hydrocarbon reservoir, obtain, from the reservoir modeler, a fluid pressure distribution at a first time, simulate, using the reservoir simulation model, a flow rate at a second time, a first fluid pressure at the second time and a second fluid pressure at a third time, wherein the second time is later than the first time and the third time is later than the second time, simulate a simulated PI for the well based, at least in part, on a quotient of the flow rate at the second time and a difference between the first fluid pressure at the second time and the second fluid pressure at the third time;

generate an updated reservoir simulation model by updating at least one parameter of the reservoir simulation model based on a difference between the measured PI and the simulated PI; and simulate the fluid pressure distribution at a fourth time using the updated reservoir simulation model;

a well planning system configured to:

identify a location of hydrocarbon based, at least in part, on the fluid pressure distribution at the fourth time; and plan a wellbore path to intersect the location; and a drilling system configured to drill a well based, at least in part, on the wellbore path.

10. The system of claim 9, wherein the reservoir simulator is further configured to simulate a second fluid pressure at a time corresponding to a rate of change of the second fluid pressure being less than a predetermined value.

11. The system of claim 9, wherein the reservoir simulator is further configured to simulate a first fluid pressure at a downhole of the well and a second fluid pressure as a far-field pressure.

* * * * *